United States Patent [19]

Clary

[11] 4,340,336

[45] Jul. 20, 1982

[54] ASPIRATOR

[75] Inventor: Thomas R. Clary, Yorba Linda, Calif.

[73] Assignee: Hudson Oxygen Therapy Sales Company, Temecula, Calif.

[21] Appl. No.: 130,867

[22] Filed: Mar. 17, 1980

[51] Int. Cl.[3] ..... F04F 5/52

[52] U.S. Cl. ..... 417/189

[58] Field of Search ..... 417/182, 182.5, 187, 417/188, 189, 151

[56] References Cited

U.S. PATENT DOCUMENTS 1,014,729 1/1912 Thurman et al. ..... 417/189

1,441,651 1/1923 Anderson et al. ..... 417/189

3,435,841 4/1969 Williams et al. ..... 417/189 X 4,056,334 11/1977 Fortune ..... 417/189

*Primary Examiner*—Carlton R. Croyle

*Assistant Examiner*—Edward Look

*Attorney, Agent, or Firm*—Seiler & Quirk

[57] ABSTRACT

A novel gas-powered aspirator comprises a venturi chamber for suctioning a vacuum jar incorporating a valve body, movable between two positions, one for directing gas to the venturi chamber, and the other for closing it from the gas supply. The valve body position is determined by the vacuum pressure in the jar.

8 Claims, 3 Drawing Figures

ASPIRATOR

BACKGROUND OF THE INVENTION

Gas-powered aspirators are well known devices useful for providing suction to clear patients' lungs, for removing secretions or blood, and to allow insertion of an airway device, or for keeping the patient's airway open for respiration or ventilation. For emergency use, the gas-powered aspirators are particularly advantageous, since they do not require the electrical sources for powering motors and pumps, but instead, operate from a source of compressed air or oxygen, normally available in emergency or rescue vehicles and ambulances.

Commonly, gas-powered suction devices are driven by using compressed oxygen which flows past a restricted passageway or orifice to create a venturi effect, which creates the vacuum suction. As convenient as such portable and emergency suctioning equipment is, the aspirators used heretofore have not shut off or terminated the oxygen flow when adequate vacuum is achieved in the device, but instead, require an operator to manually turn off the oxygen supply valve, which often, is not convenient, especially in an emergency situation. Yet, when the valve is not off, there is excessive consumption of oxygen as the flow continues, even though there is no immediate demand for the suction. It is to the elimination of this problem, and the conservation of oxygen, as well as for operator convenience, that the device of the present invention is directed.

SUMMARY OF THE INVENTION

The aspirator of the present invention is gas-powered with suction produced by directing gas through a venturi chamber which is in communication with a vacuum jar attached to the aspirator. Gas directed through the venturi produces a suction whereby gas is evacuated from the vacuum jar. A valve body is movable between two positions, one which allows gas to be directed from a gas inlet passageway to the venturi chamber for evacuating the vacuum jar, and another position in which the gas inlet passageway is closed off from the venturi, thereby automatically shutting off the main flow of gas into the device. The components and features of the aspirator of the invention as well as advantages and uses thereof will be evident from the following detailed description.

DETAILED DESCRIPTION OF THE INVENTION

Figure 1:
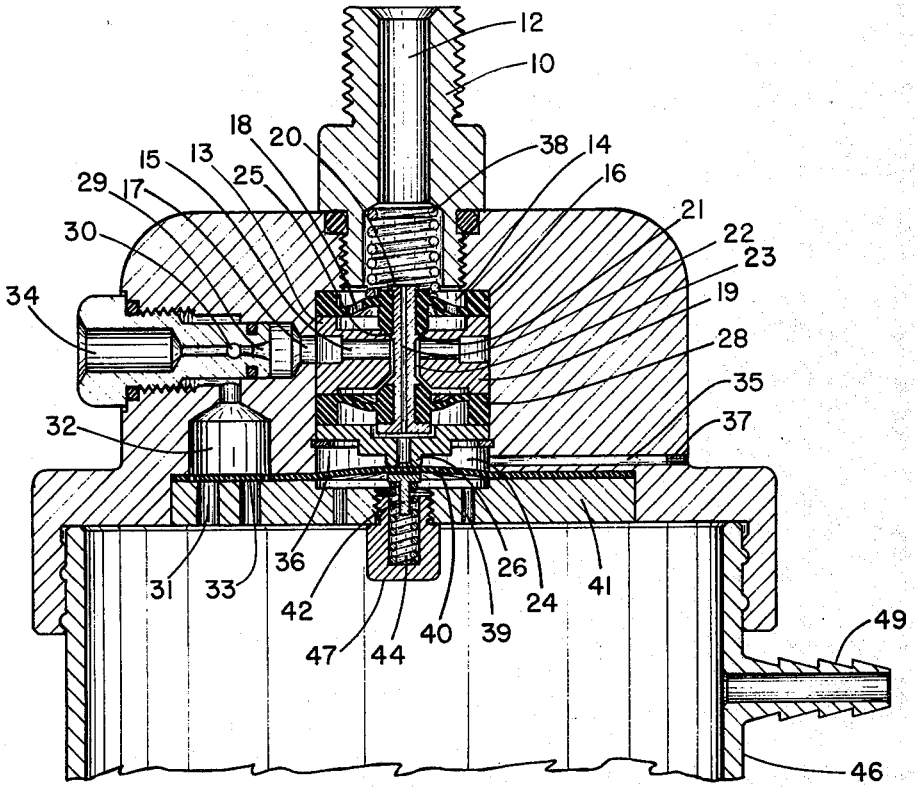
FIG. 1 is a side sectional elevation of the aspirator of the invention with the valve body in a biased position closing the gas passageway to the venturi assembly.

In FIG. 1, a gas inlet pipe 10, which is secured to a gas delivery tube, normally from an oxygen source such as an oxygen cylinder delivering oxygen at 50 psi, has an inlet passageway 12 for directing gas into the aspirator. This passageway communicates with valve cavity 14, in which is located valve stem 20. A spring 38 biases the valve stem by urging it downwardly as the device is viewed, so that passageway 23, which otherwise allows communication or forms a conduit between passageway 15 and gas inlet passageway 12 via orifice 18, is closed. A grommet 16 is secured across valve cavity 14 to valve stem 20, and has a plurality of orifices 18. Also within cavity 14 is an insert 13 having sealing surfaces 21 and passageways 15 and 23. Grommet 16 is provided with a shoulder 25 which is seated against the slanted sealing surface 21 of insert 13 when the valve is in the position shown in FIG. 1 to provide a gas seal closing off passageway 23. These structural features may also be observed in FIG. 2.

Valve stem 20 is provided with a channel 22 which extends through the valve body from top to bottom, communicating with gas inlet passageway 12 at the top, and with a pressure chamber 36 at the bottom. A first diaphragm 28 extends across the valve cavity and is secured to the valve stem adjacent its lower end, thereby providing a gas-tight upper wall for pressure chamber 36. A collar 26 is provided downwardly from the valve body and provides a seat for a second diaphragm 40. The second diaphragm 40 is movable between two positions, one is shown in FIG. 1 in which it is seated against collar 26, thereby providing a gas-tight seal between pressure chamber 36 and atmospheric chamber 24. In a second position, diaphragm 40 is pulled downwardly when sufficient vacuum is created in vacuum jar 46, such a position being illustrated in FIG. 3. Cooperating with diaphragm 40 is a diaphragm retainer 42 against which spring 44 exerts pressure, thereby biasing the retainer and diaphragm upwardly against collar 26.

The venturi assembly is in communication with valve cavity 14, specifically passageway 15 thereof via venturi inlet 17, which leads successively to restriction 29, venturi chamber 30, and venturi outlet port 34. Venturi chamber 30 also communicates with suction passageway 32, and the interior of vacuum jar 46 via one-way check valve 33 and suction port 31.

Figure 2:
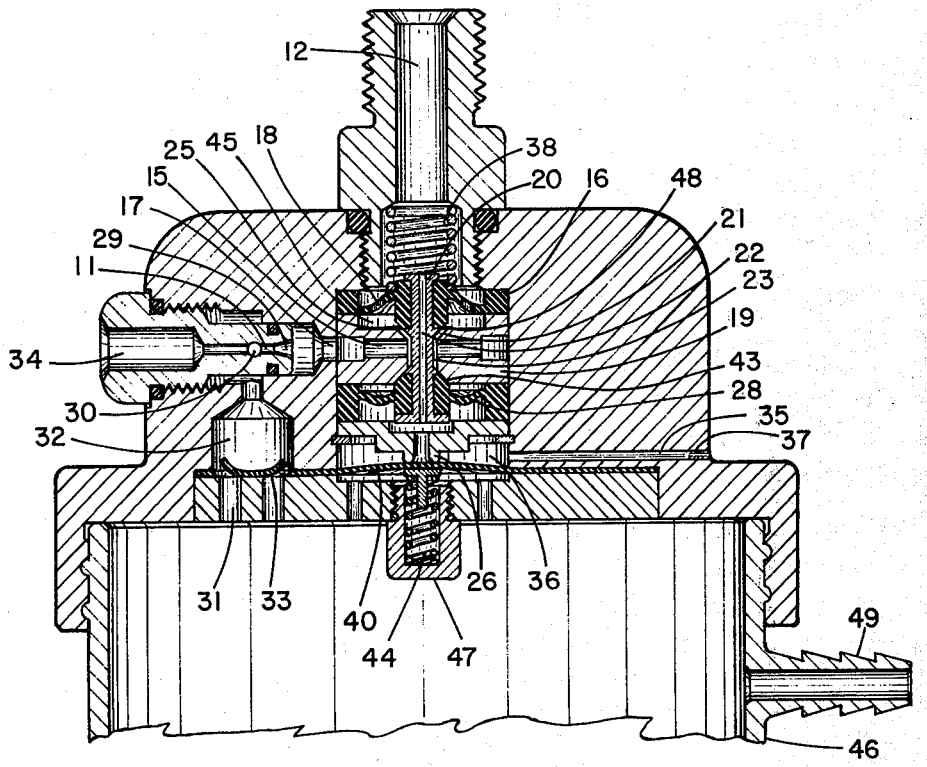
FIG. 2 is a side sectional elevation of the aspirator with the valve body in a second position to open the gas passageway to the venturi assembly for producing a vacuum in an attached vacuum jar.

In FIG. 2 the aspirator assembly is shown in a condition in which valve stem 20 has been moved upwardly thereby opening passageway 23 providing communication between gas inlet passageways 12 and 15 via orifice 18 in grommet 16. This condition is achieved as pressurized gas is directed into gas inlet passageway 12 and through the stem body via channel 22 into pressure chamber 36. With diaphragm 40 forming a gas-tight seal with collar 26, the pressure chamber is sealed off, and as the pressure builds up in the chamber, it forces diaphragm 28 upwardly, which, in turn, forces valve stem 20 to move upwardly until diaphragm seat 43 contacts lower portion 19 of insert 13 and stops. With the upward movement of valve stem 20, grommet 16 is moved away from slanted surface 21 of the upper portion of insert 13 thereby exposing passageway 23 through which pressurized gas directed into gas inlet passageway 12 passes, and on to the venturi assembly via passageway 15. Gas passing through the venturi assembly, and specifically across venturi chamber 30, causes a low pressure thereby pulling or evacuating air from the interior of vacuum jar 46 via suction port 31 and suction passageway 32.

Figure 3:
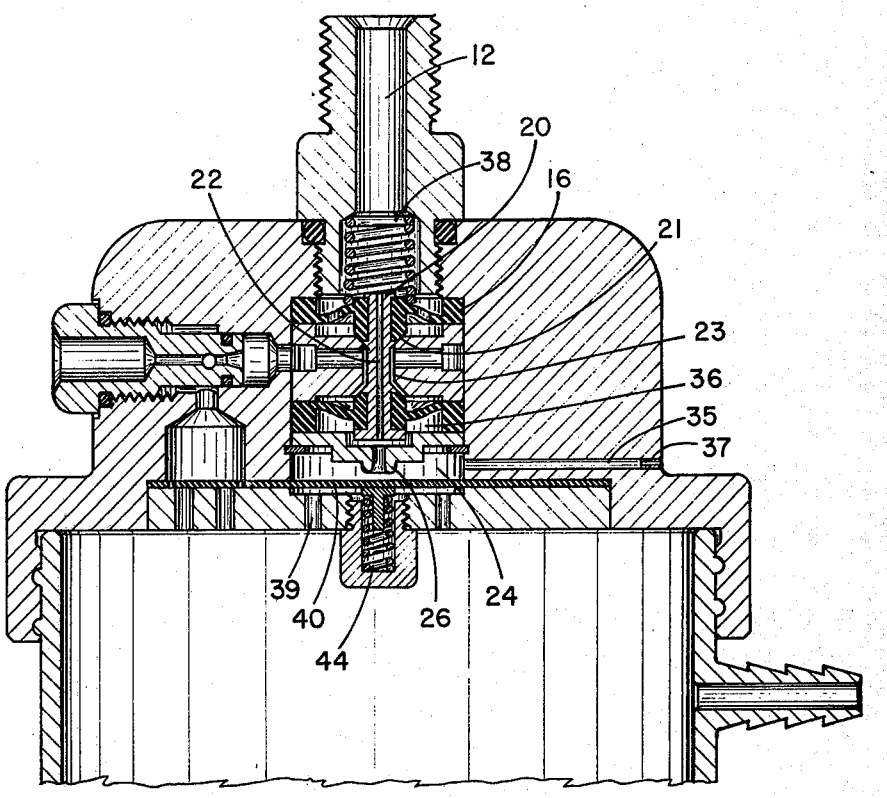
FIG. 3 is a side sectional elevation of the aspirator with the valve body again in the closed position and with the aspirator assembly showing a diaphragm condition when sufficient vacuum has been achieved in the vacuum jar.

Once sufficient vacuum is achieved in the vacuum jar, because the lower surface of diaphragm 40 is exposed to the vacuum condition in the vacuum jar via ports 39, and since the upper diaphragm surface is exposed to atmospheric pressure in atmospheric chamber 24, the diaphragm will be pulled downwardly against the bias of spring 44 as shown in FIG. 3. As this occurs, the gas seal between the diaphragm and collar 26 is broken, thereby allowing the gas pressure in pressure chamber 36 to be released through vent conduit 35. With the reduced pressure in pressure chamber 36, valve stem 20 is returned to its original position because of the bias of spring 38 downwardly against the valve stem. Pressurized gas flowing from pressure chamber 36 to atmospheric chamber 24 also forces diaphragm 40 downwardly. Once again, grommet 16 will be seated against slanted surface 21 of the upper portion of insert 13 thereby sealing off the venturi assembly from the gas inlet passageway. Thus, further substantial loss of gas which is unnecessary because of the sufficient vacuum condition in the vacuum jar is prevented. This condition will remain until such time as the vacuum in the vacuum jar is reduced to such a pressure that spring 44 overcomes the reduced pressure condition thereby allowing diaphragm 40 to move upwardly and once again seat against collar 26.

In operating the aspirator of the invention, it will be understood that a suction hose or flexible tubing will be secured to barbed suction pipe 49, and the opposite hose end is attached to the suction hand piece having control means for being opened and closed. This control means includes a control valve having a gas-tight seal, so that vacuum created in the vacuum jar 46 will be retained when the hand held suctioning instrument is closed. However, when the control valve is opened by an operator, an open passageway is provided into the vacuum jar by the hand piece, tubing and suction pipe 49. Inlet pipe 10 is secured to oxygen supply tubing, and once a regulator valve is opened, the compressed oxygen, normally at 50 psi, is directed into passageway 12. Initially, the valve stem and diaphragms are in the position as shown in FIG. 1, whereby passageway 23 is sealed, so that no gas can be directed into the venturi assembly. However, channel 22 in the valve stem is always open, and the pressurized gas is directed through the channel into pressure chamber 36. As the pressure in the pressure chamber builds up, diaphragm 28 is forced upwardly against the downward bias of spring 38 against valve stem 20. Once the pressure in the pressure chamber is sufficient to overcome the downward bias of the spring, the valve stem is moved upwardly to the position shown in FIG. 2.

With the valve stem in the position shown in FIG. 2, passageway 23 is open between upper chamber 45 and passageway 15. Accordingly, the pressurized gas in gas inlet passageway 12 is directed through orifice 18 into the top chamber, along passageway 23 into passageway 15, and to the venturi assembly. Gas directed to the venturi assembly passes successively along venturi inlet passageway 17, restriction 29, and venturi chamber 30. As the pressurized gas is forced along the relatively narrow throat 11 between restriction 29 and venturi chamber 30, its velocity is substantially increased. This high velocity, low pressure gas then passes across venturi chamber 30 creating a negative pressure which entrains gas into the chamber from suction passageway 32. This negative pressure accordingly entrains gas from the interior of vacuum jar 46 through suction port 31, past one-way check valve 33, into the venturi assembly and out through venturi outlet port 34. The check valve 33 may be any suitable plastic or rubber device or cover which simply allows gas to pass only one way, from the vacuum jar to the venturi assembly, and provides a gas seal against any gas moving into the jar from suction passageway 32.

Once sufficient vacuum is achieved in the vacuum jar, diaphragm 40 is pulled downwardly against the upward bias of spring 44 to the position shown in FIG. 3. In a preferred embodiment, spring 44 is adjustable so that the amount of upward bias against diaphragm 40 can be varied and selected thereby allowing a variation in the amount of vacuum in the vacuum jar required to pull diaphragm 40 downwardly. With the diaphragm in the downward position, the gas-tight seal between the diaphragm and collar 26 is open, whereby the gas pressure in pressure chamber 36 is released via atmospheric chamber 24, vent conduit 35 and restricted vent port 37. With the pressure in pressure chamber 36 being so reduced, the force of spring 38 against valve stem 20 is once again sufficient to force the valve body downwardly to the position shown in FIGS. 3 and 1, thereby occluding passageway 23. In this condition, the pressurized gas in gas inlet passageway is no longer able to flow to the venturi chamber, so that further evacuation of the vacuum jar is discontinued, thereby substantially shutting off the flow and use of pressurized gas. It is this conservation of the pressurized oxygen that achieves a substantial improvement in the device of the invention over other gas-powered aspirators known in the prior art. This condition of the valve and diaphragm components shown in FIG. 3 is maintained until such time as use of the suction equipment for aspirating fluids or materials into the vacuum jar reduces the vacuum in the jar such that the upward bias of spring 44 against diaphragm 40 can no longer be overcome, thereby returning that diaphragm shown in FIGS. 1 and 2. As this occurs, a gas-tight seal is again formed between the diaphragm and collar 26, thereby causing pressure chamber 36 to again be pressurized as previously explained.

It will be noted that channel 22 in the valve stem is always open, although it is quite narrow, thereby allowing pressurized gas from gas inlet passageway to flow therethrough when preset vacuum levels are achieved, i.e., when the diaphragm 40 is in its downward position. However, because of the substantial restriction of this conduit, the amount of gas flow is not great. Moreover, in the condition shown in FIG. 3 in which there is sufficient vacuum in the vacuum jar to keep diaphragm 40 from sealing against collar 26, the gas flowing through conduit 22 simply passes into atmospheric chamber 24, which is always open to atmosphere via vent conduit 35 and restricted vent port 37. The restriction of vent port 37 is important in that if it is too large, the valve stem may fluctuate between the open and closed positions too rapidly. On the other hand, if the restricted port opening is too small relative to the size of the opening along channel 22, the gas flow rate through the valve stem would be greater than the flow out of pressure chamber 24 such that the pressure could not be properly released once diaphragm 40 is moved downwardly. An on-off range can be established by controlling the size of vent port 37.

A liquid impermeable membrane may also be used between the lower surface of the aspirator cap exposed to the vacuum jar, and the vacuum jar interior, to prevent fluids drawn into the jar from contacting the aspirator, should the jar and aspirator be tipped over or over filled. In addition, any desired shapes of the passageways, valves, diaphragms as well as other components described in the device may be varied or changed to achieve the equivalent function, within the purview of the invention.

I claim:

1. An aspirator assembly for evacuating gas from a vacuum chamber comprising (a) a valve cavity having a gas inlet passageway and a gas outlet passageway;

(b) a valve stem, movable between a first and second position having a channel extending through the stem, said channel having an inlet port communicating with said gas inlet passageway, and an outlet port;

(c) a first diaphragm secured to said valve stem and extending across said valve cavity;

(d) a valve chamber communicating with said first diaphragm and said outlet port;

(e) a second diaphragm, having a bottom surface exposed to said vacuum chamber, a top surface exposed to an atmospheric chamber, and movable between a first and second position;

(f) a venturi assembly comprising a venturi tube, a suction chamber connecting said vacuum chamber with said venturi tube, and a conduit connecting said venturi tube with said gas outlet passageway;

(g) first sealing means cooperating with said second diaphragm for forming a gas tight seal between said atmospheric chamber and said valve chamber; and (h) second sealing means cooperating with said valve stem for forming a gas tight seal between said gas inlet passageway and said gas outlet passageway.

2. The aspirator assembly of claim 1 including first biasing means for urging said valve stem to said first position whereby said second sealing means forms said gas tight seal.

3. The aspirator assembly of claim 2 including second biasing means for urging said second diaphragm to a first position whereby a gas tight seal is formed therebetween and said first sealing means.

4. The aspirator assembly of claim 3 wherein said second sealing means comprises a grommet having at least one orifice therethrough communicating with the gas inlet passageway, said grommet being secured to said valve stem.

5. The aspirator assembly of claim 1 including a vent port between said atmospheric chamber and atmosphere.

6. An aspirator assembly for evacuating gas from a vacuum chamber comprising:

a gas inlet passageway;

a venturi pipe communicating with said gas inlet passageway;

a suction chamber connected to said venturi pipe and means connecting said suction chamber with said vacuum chamber;

a valve assembly for closing said gas inlet passageway including a movable valve stem and a first diaphragm secured thereto, said valve stem movable between a first position in which said gas inlet passageway is closed, and a second position in which said gas inlet passageway is open, said valve stem including a conduit communicating with said gas inlet passageway;

a pressure chamber communicating with said conduit and said first diaphragm;

a second diaphragm having a first surface exposed to said vacuum chamber and a second surface exposed to an atmospheric chamber, said second diaphragm being movable between a first position in which said atmospheric chamber is sealed from said pressure chamber, and a second position in which said pressure and atmospheric chambers are open to one another.

7. The aspirator assembly of claim 6 including a gas sealing member secured to said valve stem for closing said gas inlet passageway when said valve stem is in said second position.

8. The aspirator of claim 6 including a first biasing means for urging said valve stem to said first position, and a second biasing means for urging said second diaphragm to said first position.

* * * * *